United States Patent [19]

Macomber

[11] 4,349,925

[45] Sep. 21, 1982

[54] PHYSIOLOGICAL PILLOW

[75] Inventor: James K. Macomber, 12 Gina Dr., Centerport, N.Y. 11721

[73] Assignee: James K. Macomber, Centerport, N.Y.

[21] Appl. No.: 130,154

[22] Filed: Mar. 13, 1980

[51] Int. Cl.[3] ..... A47G 9/00

[52] U.S. Cl. ..... 5/431; 5/435; 5/436

[58] Field of Search ..... 5/435, 436, 440, 441

[56] References Cited

U.S. PATENT DOCUMENTS

| | | | |
|---|---|---|---|
| 205,929 | 7/1878 | Wallace | 5/435 |
| 1,580,210 | 4/1926 | McCulloch | 5/436 |
| 2,149,140 | 2/1939 | Rincone | 5/436 |
| 2,782,447 | 2/1957 | Ericson | 5/436 |
| 3,124,812 | 3/1964 | Milton et al. | 5/435 |
| 3,337,883 | 8/1967 | Allison | 5/435 |
| 3,694,831 | 10/1972 | Trease | 5/435 |
| 3,757,365 | 9/1973 | Kretchmer | 5/436 |
| 4,074,376 | 2/1978 | Bond | 5/435 |
| 4,118,813 | 10/1978 | Armstrong | 5/436 |

*Primary Examiner*—Roy D. Frazier
*Assistant Examiner*—Peter A. Aschenbrenner
*Attorney, Agent, or Firm*—Kane, Dalsimer, Kane, Sullivan & Kurucz

[57] ABSTRACT

This invention relates to a pillow so designed as to allow a person to sleep comfortably in a prone position. The pillow is shaped to relieve pressure on the sleeper's eyes, nose, throat, shoulders and blood vessels and glands of the neck. Several of the most common causes of snoring are eliminated, so a person sleeps more soundly and quietly.

8 Claims, 18 Drawing Figures

FIG. 1
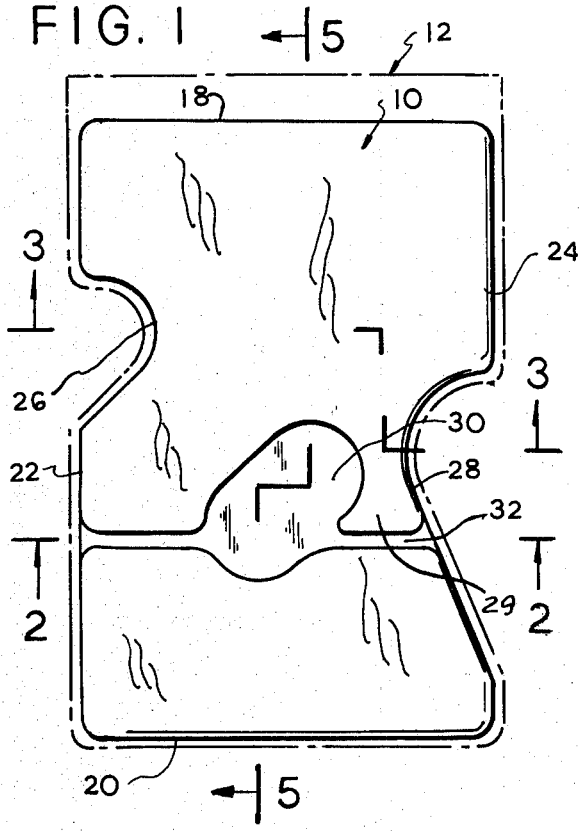
FIG. 4
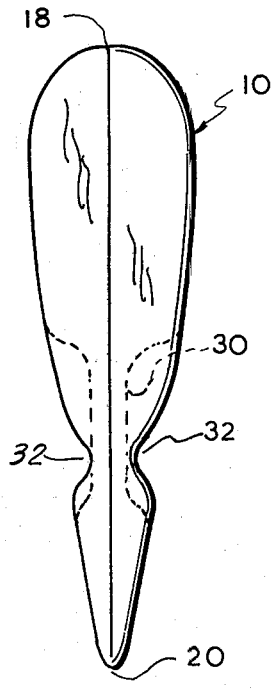
FIG. 2
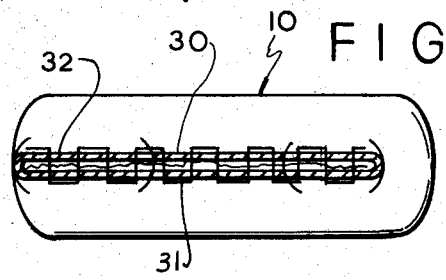
FIG. 5
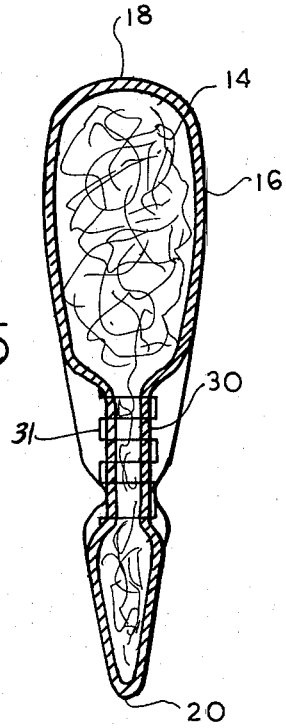
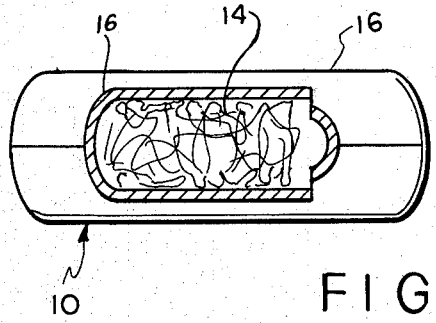
FIG. 3

FIG. 6
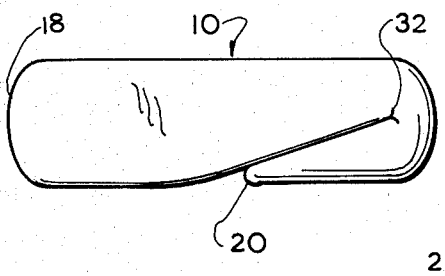
FIG. 10
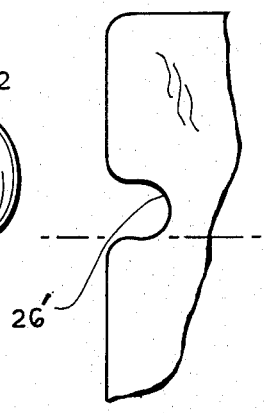
FIG. 11
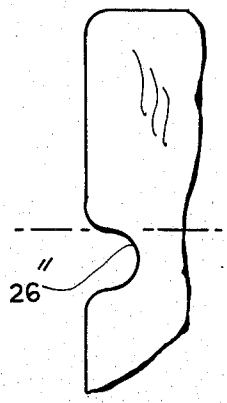
FIG. 7
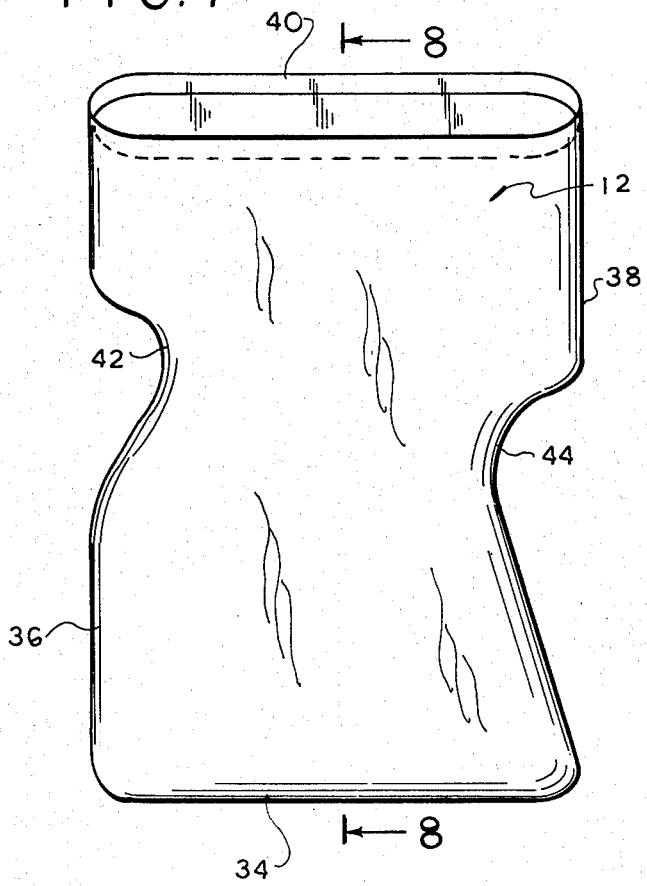
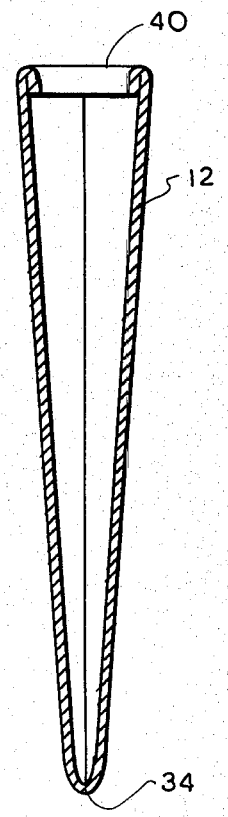
FIG. 8

PHYSIOLOGICAL PILLOW

BACKGROUND OF THE INVENTION

It is a well known fact that many people do not sleep comfortably. Hundreds of millions of sleeping pills are consumed annually. The sleeper frequently moves one part of his body or another and occasionally turns over completely. These movements usually occur about twenty to forty times during the night, being largely the attempt of the sleeper to alleviate discomfort due to prolonged pressure against sensitive parts of the body.

The object of this invention is to relieve this situation by producing a pillow which allows a person to sleep comfortably and soundly in a prone position.

A further object of this invention is to cause the sleeper to sleep quietly. There are estimated to be more than twenty million arthritics in America, most of whom cannot sleep on either side without pain developing in a shoulder, hip, knee or in the back. If one attempts to sleep on his back, he is subject to the effect of gravity, making his jaw, tongue and soft palate sag, causing him to breathe through his mouth and snore. He can, however, turn over to a prone position and sleep comfortably and quietly providing his shoulders and neck are substantially relieved of pressure, and providing there is no pressure on his eyes and nose, allowing him to breathe freely through both nostrils.

Another object is to provide a tapered pillow, for more comfort while sleeping prone, with a provision to allow the pillow to be quickly folded to substantially eliminate the taper, in case the sleeper desires to lie on his side or back.

Another object is to provide a pillowcase which is open at the head end, beyond the sleeper's head, thereby preventing contact of the cushion inside with any part of the human body. This arrangement, with the pillowcase being folded and seamless at the chest end and sewn together only along the sides, avoids discomfort which would be caused by the thicker hemmed edge bearing against the sleeper's chest if the opening of the pillowcase were at the chest end. For the same reason, the cushion covering is folded and seamless at the chest end and sewn together on the sides and at the head end.

Further objects and advantages, as well as means to achieve them, will appear in the specification hereinbelow.

When used in this application to describe the sleeping position, the term "prone" means lying with the front of the body turned towards the suporting surface and the head turned at least partially towards one side.

BRIEF DESCRIPTION OF THE DRAWINGS

Embodiments of my invention are illustrated in the accompanying drawings in which:

FIG. 1 is a plan view of one form of pillow embodying my invention showing in dot and dash lines a pillowcase encasing the pillow;

FIG. 2 is a sectional view, along grooves extending across the pillow, in the direction of the arrows on the line 2—2 of FIG. 1;

FIG. 3 is a further sectional view in the direction of the arrows on the line 3—3 of FIG. 1;

FIG. 4 is a side view of the pillow;

FIG. 5 is a sectional view in the direction of the arrows on the line 5—5 of FIG. 1;

FIG. 6 is a view of the pillow folded upon itself along a groove extending across the pillow;

FIG. 7 is a plan view of a pillowcase for use with my pillow;

FIG. 8 is a sectional view of the pillowcase in the direction of the arrows on the line 8—8 of FIG. 7;

FIG. 10 is a detailed view showing a modified form of recess in the face edge of the pillow to provide clearance for the eye of the user;

FIG. 11 is a detailed view of another modified form of my pillow showing a recess to give clearance for the nose of the user;

DETAILED DESCRIPTION

Figure 9:
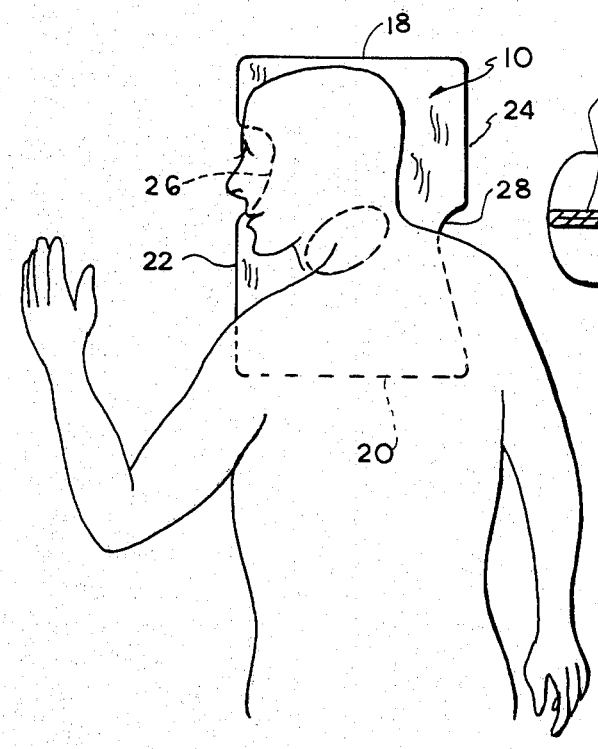
FIG. 9 is a plan view of a sleeper using my improved pillow showing the sleeper in prone position with his head turned towards one side.

Referring now to the drawings, particularly FIGS. 1–9, my improved pillow comprises generally a cushion 10 which may be and preferably is encased in a pillowcase 12 when used for supporting the head and adjacent chest portion of a person.

The cushion 10 is provided with a stuffing 14 of a soft, yieldable material such as is generally used as the filling in pillows and cushions, including natural materials such as down, soft feathers, cotton, kapok or other fibers or a synthetic material such as various types of plastic or resin foams or synthetic fibers.

The stuffing 14 is encased in a covering 16 made of a natural or synthetic textile or porous plastic material which may be made of a natural fiber such as cotton or a synthetic fiber such as polyester or nylon.

The cushion is provided with a head edge 18 and a chest edge 20 adjacent the head and chest supporting areas of the cushion as shown in FIG. 9. Also, the cushion is of a size to provide support for the head and adjacent chest portions of the body of the user as shown in FIG. 9. Connecting the head and chest edges are two side edges, i.e. a face edge 22 and a shoulder edge 24 positioned adjacent the face and one shoulder respectively of a person using the pillow while lying in prone position with the head turned towards the face edge as also shown in FIG. 9.

The covering for the cushion is preferably free of any seam at its chest edge 20 and may be seamed along its head, face and shoulder edges. In this way, there is no seam beneath the chest of the user of the pillow which would interfere with his comfort.

The cushion has a portion removed along the face edge so as to provide recess 26 to give clearance for a portion of the face of the user when lying in a prone position with the head turned towards the face edge of the cushion. The recess 26 is preferably large enough to provide clearance for both an eye and the nose of the user as shown in FIG. 9. Under certain circumstances, a smaller recess 26' may be provided in the face edge of the cushion as shown in FIG. 10, and this should be positioned to provide clearance for an eye of the user. If preferred, a smaller recess 26'' may be provided at a lower position than the recess 26' in the face edge of the cushion so as to provide clearance only for the nose of the user as shown in FIG. 11. However, I prefer to provide a recess as shown in FIGS. 1 and 9 providing clearance for both an eye and nose of the user.

It will be appreciated that the recess or clearance prevents pressure from being applied to the eye and/or nose of the user while lying in prone position with the head turned towards that side, thereby preventing discomfort in these areas and avoiding interference with the breathing of the user.

Along the shoulder edge 24 of the cushion, the cushion is preferably restricted in width between the face and shoulder side edges so as to form a shoulder clearance at the shoulder edge in vertical alignment with the shoulder of a person sleeping on the pillow in prone position with the shoulder being on the side away from which the head is turned as shown in FIG. 9. This clearance preferably takes the form of a recess 28 formed in the shoulder edge of the cushion at a point closer to the chest edge 20 than the recess 26. The recess 28 is of a shape and size to provide clearance for the shoulder of the user as shown in FIG. 9.

Figure 13:
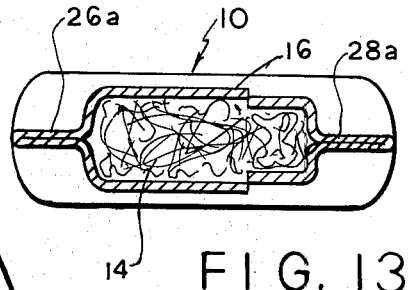
FIG. 13 is a cross-sectional view in the direction of the arrows on the line 13—13 of FIG. 12.
Figure 12:
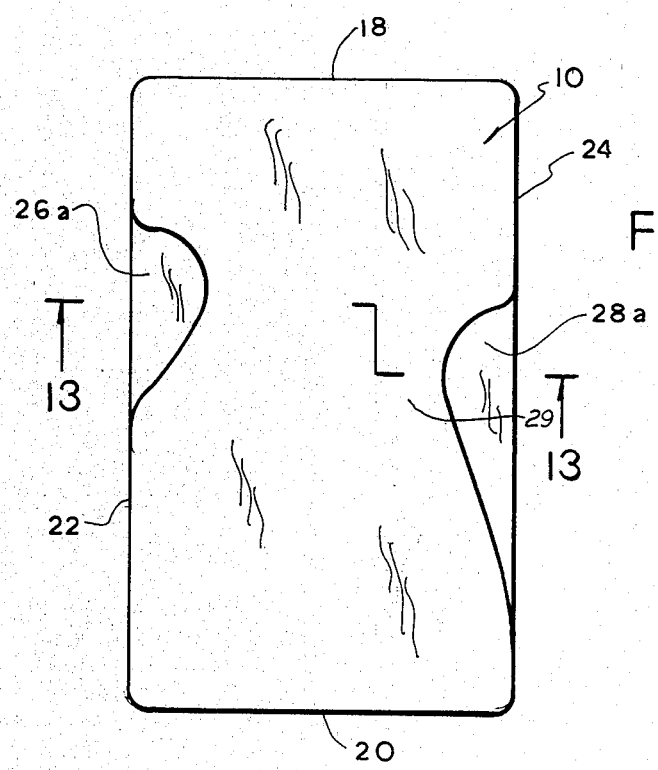
FIG. 12 is a plan view of a further modified form of pillow with different types of clearances and recesses along the face and shoulder edges of the pillow.
Figure 15:
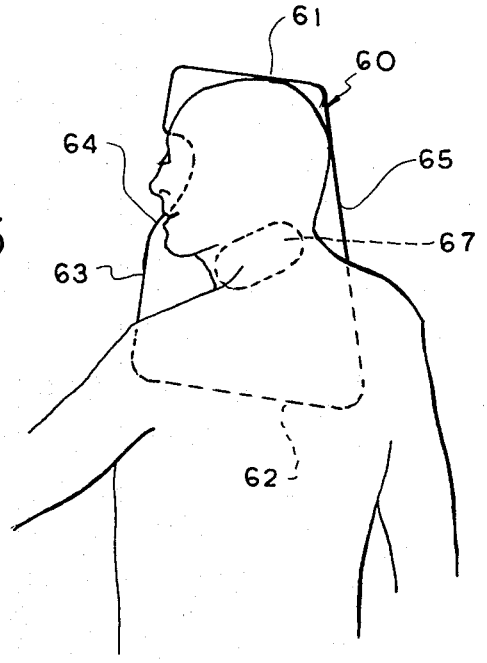
FIG. 15 is also a plan view of a sleeper in prone position using another modified form of pillow.

The recesses 26 and 28 as shown in FIG. 1 are formed by cutting away the cushion and reducing the width thereof in the areas of the recesses. Instead of completely removing the material of the cushion in these areas, the recesses or clearances may be formed by simply reducing the thickness of the cushion in the areas of the recesses as shown at **26*a* and 28*a* in FIG. 12 and FIG. 13. As indicated, the shoulder clearance preferably takes the form of a recess 28 or 28*a* but the clearance can also be accomplished by the inherent shape of the pillow as shown in FIG. 15** with the pillow having the correct dimension between the face and shoulder side edges.

In addition to providing clearance for portions of the face and for the shoulder of the user while lying in prone position, I have found that it is desirable to prevent or minimize pressure on the neck of a person lying in a prone position. For this purpose, I preferably provide an area of reduced thickness as shown at 30 in FIG. 1 positioned between the head supporting portion and the chest supporting portion. As indicated, the clearance for minimizing pressure on the neck portion is preferably provided by reducing the thickness of the cushion in that area. The reduced thickness is preferably maintained by stitching 31, FIG. 2 and FIG. 5. However, the cushion material may be entirely removed in that area so that an aperture extends completely through the cushion, or the stuffing may be removed leaving only the covering material, stitched or unstitched. Each of these arrangements is referred to herein as being of "reduced thickness".

Adjacent the shoulder clearance recess 28 is a chest supporting area 29. This cushioned area presents or minimizes pressure on the shoulder and is important for the comfort of the sleeper, particularly to a sleeper with an arthritic shoulder.

Figure 16:
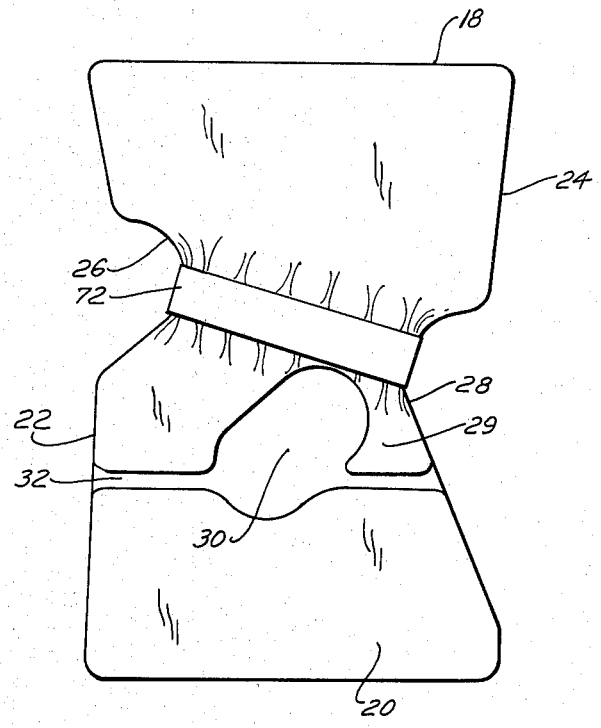
FIG. 16 is a plan view of the pillow shown in FIG. 1 having a ribbon or belt applied to adjust the pillow to the dimension of the sleeper's body.
Figure 17:
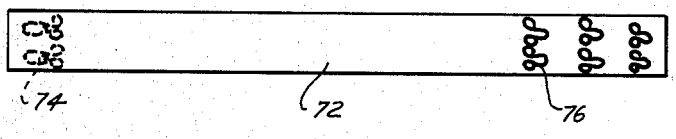
FIG. 17 is a plan view of one form of belt that may be used.
Figure 18:
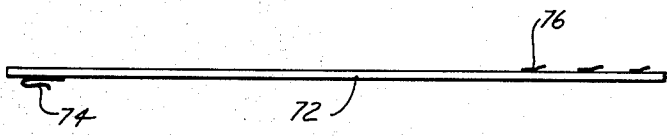
FIG. 18 is a side view of the belt of FIG. 17.

To obtain full advantage of this support adjacent the shoulder clearance, the dimension between the shoulder clearance and the eye and nose recess must conform fairly closely with the matching dimension of the sleeper's body. To accomplish this fit, I show in FIG. 16 a ribbon or belt 72, preferably made of flexible plastic or cloth, which is wrapped around the pillow and joined near the ends, before placing the pillow in its pillowcase. The effective length of the ribbon or belt is adjustable so as to reduce the face-to-shoulder dimension of the pillow to fit a smaller person. The ends of belt 72 can be fastened by means such as a belt buckle or buttons, or permanently fastened by sewing or stapling when adjusted to the proper size. FIG. 17 shows a preferred method employing hooks 74 and eyes 76, multiple rows of either or both, allowing adjustment over a wide range. FIG. 18 shows a side view of FIG. 17. Belt 72 can be adapted to the pillow shown in FIG. 15 by pinning the belt to the pillow at the shoulder clearance by suitable fastening means such as a safety pin.

For purposes of comfort, I prefer to have the cushion tapered in thickness from a point adjacent the head edge towards a point adjacent the chest edge.

The term "tapered" when used to describe the pillow or cushion means that the pillow or cushion is thicker at the portion normally supporting the head than at the portion normally supporting the chest when used in the manner similar to FIG. 9 in the drawings. This is true when the pillow is not in use and not subject to distortion due to the weight of the sleeper. The taper is inherent in the construction of the pillow or cushion with the diminution in thickness between the head and chest area being gradual except in the areas of the groove and of reduced thickness as herein described—but the diminution in thickness is not necessarily at a constant rate.

While my improved pillow is so designed as to allow a person to sleep comfortably in a prone position, it may also provide comfort to a user in positions other than prone. For this purpose, I preferably provide a fold line in the form of a groove, or grooves, forming a line of reduced thickness extending across the cushion adjacent the chest supporting area as indicated at 32. This may be accomplished by extending a line of stitching 31 between the two sides of the cover and reducing the amount of stuffing along the line of stitching. When it is desired to use the pillow for positions other than prone, the user may fold the cushion along the groove, or grooves, 32 as shown in FIG. 6, providing a relatively flat untapered support.

My improved pillow may be employed in the form of a cushion without a pillowcase if desired. However, for sanitary and cosmetic purposes, I prefer to provide a pillowcase 12 as shown in greater detail in FIGS. 7 and 8. The pillowcase is preferably formed in one piece folded upon itself along chest edge 34 and stitched together along face edge 36 and shoulder edge 38 and open at its head edge 40 so that the cushion may be inserted and removed through the open top end. Due to this preferred construction, there is no seam along the chest edge 34, thereby preventing discomfort that might result from such a seam. The pillowcase is tapered to conform generally with the taper of the cushion from a point adjacent its open head edge to a point adjacent its folded chest edge.

The face edge of the pillowcase is provided with a recess 42 conforming with the face clearance recess formed in the face edge of the cushion. Similarly, it is formed with a recess 44 on its shoulder edge conforming to the shoulder clearance recess 28 formed in the cushion.

The forms of pillow shown in FIGS. 1–13 may be used in the manner illustrated in FIG. 9 by a sleeper in prone position with his face turned at least partially towards the face edge of the pillow. When thus used, the prone sleeper will be comfortable and relatively free from uncomfortable pressure on his eyes and nose and his shoulder and he will be free from uncomfortable pressure on his neck portion. The person thus using the pillow can sleep comfortably and soundly in a prone position. He can breathe comfortably and will be relatively free from snoring or other noises caused by his own discomfort.

Figure 14:
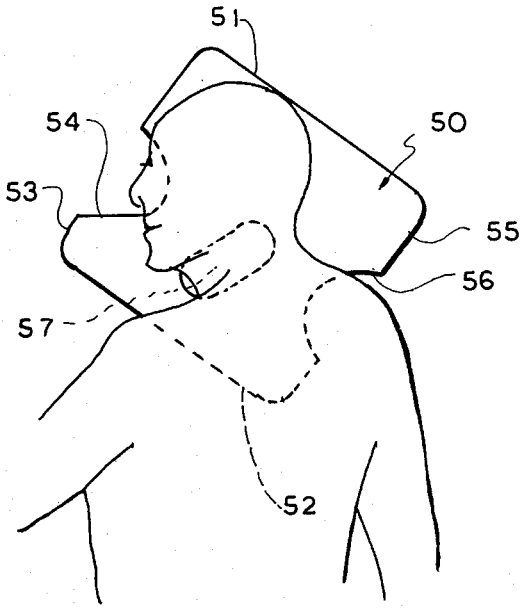
FIG. 14 is a plan view of a sleeper in prone position using a further modified form of pillow.

In FIGS. 14 and 15 I have shown modified forms of cushions providing clearance for the eyes, nose and shoulder of the user and preventing or minimizing pressure on the neck of the user.

Cushion 50 shown in FIG. 14 is used in a relatively diagonal position with respect to the sleeper and tapers in thickness from the upper edge portion 51 to the lower edge portion 52. Face edge 53 is provided with a recess 54 giving clearance for the eyes and nose of the user and shoulder edge 55 is provided with a shoulder clearance 56 providing clearance for the oppositely disposed shoulder of the user. An area of reduced thickness 57 is provided adjacent the head portion of the cushion so as to prevent or minimize pressure on the neck of the user. The cushion 50 is formed similar to cushion 10 in that it has a stuffing of soft, yieldable material encased in a textile or porous plastic cover and is preferably free from any seam at the chest edge portion thereof. A suitable pillowcase may be used to enclose the cushion.

Cushion 60 shown in FIG. 15 tapers in thickness from a point adjacent the head edge 61 to a point adjacent the chest edge 62. In addition, it tapers in width from the chest edge to the head edge. The face edge 63 is provided with a clearance or recess 64 to accommodate the eye and nose area of a person lying on the pillow in prone position with the head turned towards the face edge 63. The portion of the cushion adjacent the head edge 61 is a head supporting area large enough to accommodate the head as shown in FIG. 15 and the portion of the cushion adjacent the chest edge 62 is of a size to accommodate the chest area of the person lying in prone position with the shoulder positioned opposite the direction in which the face is directed overlapping the shoulder edge 65, thereby providing clearance to accommodate the shoulder and relieve pressure on same. The cushion 60 also preferably has an area 67 of reduced thickness adjacent the head supporting portion to prevent or minimize pressure on the neck of a user lying in a prone position.

The cushion 60 likewise may be formed in the same manner as cushion 10 shown in FIG. 1 having a suitable stuffing of soft, yieldable material encased in a textile fabric or porous plastic covering which is preferably free of any seam along its chest edge 62. A pillowcase of a size and shape to accommodate the cushion 60 may also be provided, and this is preferably open at its head end and closed across its chest edge and the face and shoulder edges. The chest edge is preferably free of any seam.

It will thus be seen that in each form of my invention I have provided a pillow so designed as to allow a person to sleep comfortably in a prone position. The pillows are shaped to relieve pressure on the sleeper's eyes, nose, throst, and shoulders, and on the blood vessels and glands of the neck. Thus, a person using the pillow is comfortable and the most common causes of snoring are eliminated so the person can sleep more soundly and quietly.

I claim:

1. A pillow particularly useful for a person sleeping in a prone position with the head turned at least partially to one side comprising a cushion formed of soft yielding material and of a size to support the head and adjacent chest portion of a person using the pillow, said cushion having a head area to support the head of the person, a chest area to support at least a portion of the chest of the person, said cushion being tapered generally in a direction from said head area towards said chest area and said cushion having a groove extending at least partway across the cushion between the head area and the chest area so that it can be folded along the groove to facilitate the use of the pillow during positions of the user other than prone.

2. A pillow as set forth in claim 1 having a pillowcase in the form of an envelope in which the cushion is disposed having a head edge near the head area of said pillow, a chest edge near the chest area of said pillow and two side edges, said pillowcase being closed at its side edges, open at its head edge so that the cushion may be removed and inserted therethrough and having a closed seamless chest edge, said pillowcase being tapered towards the closed seamless chest edge so as to accommodate the tapered cushion therein.

3. A pillow particularly useful for a person sleeping in a prone position with the head turned at least partially to one side comprising a cushion formed of soft yielding material of a size to support the head and at least the adjacent chest portion of a person when using the pillow, said cushion having a head area to support the head of a person when using the pillow, a chest area to support at least a portion of the chest of the person, said cushion being tapered generally in a direction from said head area towards said chest area, and having a head edge near the head area, a chest edge near the chest area and two side edges, the cushion further having a portion removed along the first side edge to provide a recess of a size and location to give clearance for an eye and the nose of the user when lying in a prone position with the head turned towards said first side edge and having a clearance at its second side edge for the shoulder of the user which is disposed adjacent to the said second side edge when lying in prone position, and said cushion also having a portion of reduced thickness between said head area and said chest area to prevent or minimize pressure on the neck of a user lying in a prone position.

4. A pillow as set forth in claim 3 in which a groove extends at least partially across the cushion adjacent the chest area so that it can be readily folded along the groove to facilitate the use of the pillow by a user in positions other than prone.

5. A pillow as set forth in claim 3 having a pillowcase in the form of an envelope in which the cushion is disposed, having a head edge near the head area of said pillow, a chest edge near the chest area of said pillow and two side edges, said pillowcase being formed with a folded and seamless chest edge, seams on its side edges and open at its head edge so that the cushion may be removed and inserted therethrough, said pillowcase being tapered towards its chest area so as to accommodate the tapered cushion therein.

6. A pillow as set forth in claim 3 in which a belt is disposed around the pillow and extends through the shoulder clearance area so as to adjust the size of the pillow to conform with the dimensions of the person using it.

7. A pillow as set forth in claim 3 in which a belt is disposed around the pillow and extends through the clearance for the eye and nose and the clearance for the shoulder so as to adjust the size of the pillow to the dimensions of the person using it.

8. A pillow particularly useful for a person sleeping in a prone position with the head turned at least partially to one side comprising a cushion formed of soft yielding material of a size to support the head and at least the adjacent chest portion of a person when using the pillow, said cushion having a head area to support the head of a person when using the pillow, a chest area to support at least a portion of the chest of the person, and having a head edge near the head area, a chest edge near the chest area and first and second side edges, the cushion further having a portion removed along the first side edge to provide a recess of a size and location to give clearance for an eye and the nose of the user when lying in a prone position with the head turned towards said first side edge and having a clearance at its second side edge for the shoulder of the user which is disposed adjacent to the said second side edge when lying in prone position, and said cushion also having a portion of reduced thickness between said head area and said chest area to prevent or minimize pressure on the neck of a user lying in a prone position.

* * * * *

UNITED STATES PATENT AND TRADEMARK OFFICE

CERTIFICATE OF CORRECTION

PATENT NO. : 4,349,925

DATED : September 21, 1982

INVENTOR(S) : JAMES K. MACOMBER

It is certified that error appears in the above-identified patent and that said Letters Patent is hereby corrected as shown below:

COLUMN 3, LINE 62 - CHANGE "PRESENTS" TO "PREVENTS"

Signed and Sealed this

*Sixteenth* Day of *October 1984*

[SEAL]

*Attest:*

GERALD J. MOSSINGHOFF

*Attesting Officer*

*Commissioner of Patents and Trademarks*